United States Patent [19]

Brown

[11] 4,105,159

[45] Aug. 8, 1978

[54] COMPOSITE RAILROAD TIE

[76] Inventor: Gordon Eldred Brown, 1960 W. 25th, Eugene, Oreg. 97405

[21] Appl. No.: 730,188

[22] Filed: Oct. 6, 1976

[51] Int. Cl.[2] ..... E01B 3/02

[52] U.S. Cl. ..... 238/36; 238/37; 238/84; 428/528

[58] Field of Search ..... 238/29, 36, 37, 83, 238/84; 428/529, 526, 528

[56] References Cited

U.S. PATENT DOCUMENTS

| | | | |
|---|---|---|---|
| 598,127 | 2/1898 | Williams | 238/83 |
| 875,856 | 1/1908 | Schuman | 238/83 |
| 2,257,833 | 10/1941 | Baseler et al. | 238/83 |
| 3,308,013 | 3/1967 | Bryant | 428/529 |
| 3,463,746 | 8/1969 | Murdock et al. | 260/9 |
| 3,598,312 | 8/1971 | Hamilton, Jr. | 238/55 |
| 3,869,326 | 3/1975 | Matzke | 428/526 |
| 3,908,902 | 9/1975 | Collins et al. | 238/83 |
| 3,927,235 | 12/1975 | Chow | 428/526 |

FOREIGN PATENT DOCUMENTS

| | | | |
|---|---|---|---|
| 212,723 | 2/1958 | Australia | 428/529 |

*Primary Examiner*—Drayton E. Hoffman
*Assistant Examiner*—Carl Rowold
*Attorney, Agent, or Firm*—James D. Givnan, Jr.

[57] ABSTRACT

A composite railroad tie of structurally distinct components adhesively joined in layers to form a unit. At least one of the components being of high density phenol-formaldehyde bonded particleboard manufactured in a platen press with heat. At least two elements disposed close to and parallel the broad surfaces are composed of lumber with grain direction oriented parallel the long axis. A remaining centermost element, affixed to the above two lumber elements, is relatively non-critical, being selected from lumber or particleboard of adequate shear and compressive strength on the basis of availability, cost, ease of treatment with preservative, etc.

1 Claim, 5 Drawing Figures

COMPOSITE RAILROAD TIE

BACKGROUND OF THE INVENTION

In the U.S., railroads replace over twenty million ties per year. The service life of solid wood ties is diminished because of inadequate resistance to compression and impact stresses, resulting in mechanical damage to the tie at the point of tie plate contact and loosening of the spikes due to compressive failures. Also, adequate penetration of preservative into a tie is difficult and, when checking occurs in service, a means of invasion by water and micro-organisms is provided to the under-treated tie interior. Still further, the trend to larger ties to withstand increasing traffic axle loads is hampered by reduced premium timber resources.

Several attempts have been made to develop ties of improved serviceability by consolidating comminuted wood. Three advantages of doing so are readily apparent:

1. densities are easily attained which eliminate compression damage,
2. preservative may be uniformly distributed on the wood before consolidating, and
3. uniformity of wood with absence of knots, checks or other defects to minimize rejects and in service failures.

Thus, commercial quarter inch hardboard laminated with glue to the usual tie thickness has been extensively studied but not adopted. One reason being the cost of the large glueline areas is substantial.

A tie prepared by consolidating the full thickness in one unit eliminates the glueline expense, but encounters a slow-to-heat mass and associated manufacturing problems, along with possible beam strength deficiencies.

SUMMARY OF THE INVENTION

The present invention utilizes a composite of adhesively combined elements selected to meet specific criteria particularly well. For example, resistance to compression and impact damage is required at the upper surface where the stress will be applied in service, and for a certain depth from that surface to a plane where the compressive stress is sufficiently broadly distributed.

High density particleboard is well suited to this function. Also, ties must have adequate strength when loaded as a beam, e.g., where the road bed has a high center acting as a fulcrum. Particleboard, however, is almost always inferior to lumber in tensile strength, and as tensile loads are imparted to a load bearing tie i.e., in the surface region opposite the center loading of the tie, such a deficiency must be remedied. Accordingly, the present tie has lumber components positioned parallel the top and bottom face and spaced, at most, a minor distance from them. A center element of the present tie is of lumber or particleboard. Said center element need not be one piece but should be continuous from top extremity to bottom extremity of the element viewed endwise as the tie is installed, and adhesively or otherwise joined to the adjacent upper and lower components.

The present invention is directed to a product usable as a railroad tie comprising multiple components having differing functions and usually adhesively laminated with the joined surfaces substantially parallel to the broad surfaces of the tie. Important objectives of the present invention include the provision of a railroad tie of extremely long serviceability; one of a reasonable cost-to-life ratio; one having adequate preservative in inner areas as well as on exterior surfaces and one not dependent on ever decreasing premium timber resources.

BRIEF DESCRIPTION OF THE DRAWING

The accompanying drawing discloses the present tie invention in FIGS. 1, 2, 3 and 4 each being a perspective view with the illustrated tie ends being typical of the construction throughout the length of the ties.

DETAILED DESCRIPTION OF THE PREFERRED EMBODIMENTS

Figure 1:
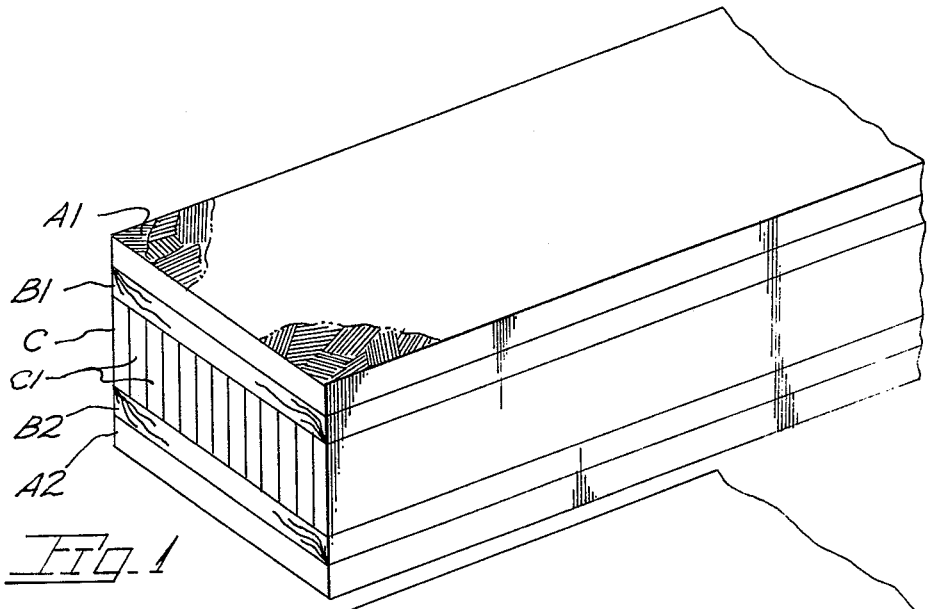

With continuing attention to the drawing wherein tie structure is indicated by reference letters corresponding to like reference letters in the following description, tie components are designated at A-1, B-1, C, C-1, B-2 and A-2, respectively from top to bottom in FIG. 1. Outer elements at A-1 and A-2 may be similar as may be inner elements B-1 and B-2, within the scope of the present invention.

Outer elements A-1 and A-2 hereinafter also referred to as uppermost and bottommost elements are made of consolidated comminuted cellulosic plant material, hot-pressed to a density of 0.75 to 1.2 grams per cc using at least 2% phenol-formaldehyde resin as a binder. A preservative against biological attack is preferably included before consolidating. Inner elements B-1 and B-2 comprise flat lumber dimensional boards continuous from end to end with grain direction parallel to the tie centerline. Selection of wood grade and species is made on the basis of tensile strength and density, although other factors are, of course, important.

Desirable tensile strength and compression strength parallel to the grain to meet the load-tensioned zone requirements at and near one tie surface and the load-compression stressed zone requirements at and near the opposite tie surface are provided by the inner wood elements in distinction to particleboard, which has good compression resistance but relatively poor tensile strength.

It is recognized that compressive strength and impact resistance are related to density and that consolidated articles can be made at much higher densities than natural wood. Therefore, I use a high density consolidated uppermost element A-1 as the top broad surface while a similar element A-2 is symmetrically used as the bottommost element. Such dual placement is preferred to balance and simplify the assembly and avoid having to orient the tie during handling and installation. The use of consolidated comminuted cellulosic material has the added advantages:

1. uniformity with the absence of defects, knots, and internal stresses that promote checking,
2. easily added, controllable concentration of preservative in all areas,
3. the possibility of using recycled wood that already contains a preservative is obviously desirable for reasons of ecology and economy.

The density of A-1 may range from 0.75 to 1.2 grams per cubic centimeter with a thickness of between 6.35 mm and 50.8 mm. Lumber element B-1 and B-2 should be selected for good tensile strength with the absence of short grain. A minimum thickness of 6.35 mm is necessary to contribute the desired modulus of elasticity in bending loads expected.

Interiorly of the tie is a central or innermost component C of wood selected from the group consisting of dimensioned lumber and consolidated hotpressed comminuted cellulosic material, e.g. particleboard wherein the particleboard has its fibers substantially in parallel relationship to its pressed broad faces. When particleboard is used, it will be seen that common manufactured thicknesses can be utilized facilitating manufacture i.e., ⅜ inch, ½ inch, ⅝ inch, ¾ inch (19mm) or 1 inch. A plurality of particleboard lamina C-1 are adhesively joined with their broad face perpendicular to the broad faces of the FIG. 1 tie. Since the function of the horizontal center of a beam is to resist horizontal shear along and near the neutral axis, this configuration, with upright particleboard lamina and its random fibre orientation, provides more strength than one in which the shear force is applied to particleboard or wood parallel its broad faces. Thus, a lower density board can be used with attendant lower cost. The earlier enumerated advantages of consolidated comminuted cellulosic material again apply.

For reasons of supply, cost, and availability in a given locality, it may be expedient to use ordinary dimensioned lumber boards at C-1 as adequate horizontal shear stress resistance are thereby provided. Since component C is of uniform depth from top to bottom but not necessarily continuous from side to side, various thicknesses of dimensioned lumber may be assembled and utilized for component C with board broad surfaces perpendicular the broad faces of the tie. Pieces adhesively joined with durable structural joints are considered here to be continuous and interchangeable with solid pieces of like dimension and composition. Elements C-1 must be continuous from top to bottom, that is, from its boundary with the element above it to its boundary with the element below it. The same need not be continuous end to end and it need not be continuous side to side, although certain strength characteristics are thereby lessened. It may be desirable to spot-glue or strip-glue elements C-1 together for ease of handling during manufacture and for resistance to lateral stress moments when in use. Further, elements C-1 may be completely unitized adhesively.

The performance of a tie is largely measured by the duration of its seviceability. Replacement is most often due to mechanical damage such as "plate cut" (failure to resist impact and compression stresses) or physical deterioration such as decay, checking, etc. Also, a tie loaded to a bending stress beyond its proportional limit is permanently damaged and no longer serviceable.

Each of these failures is closely related to a zone within the tie and the physical properties in that zone.

1. Resistance to impact and compression stresses is primarily a function of the physical properties of the tie top surface supporting the steel rail-bearing plate, and a zone of limited depth from that surface.
2. Decay in a preservative-treated wood tie is often related to outer and inner tie zones differing in degree of preservative retention with differing shrinkage rates from loss of moisture with the result that checks develop to expose the under-protected interior.
3. While failure to withstand bending stress is rarely a reason fo a wood tie becoming unserviceable, it is precisely because solid lumber beams have excellent strengths in the zones involved. Straight grained pieces of lumber are therefore thin relative to the cross-sectional dimensions of ordinary functional wood ties, and are accordingly much easier to treat with preservative and also to dry or season from green moisture contents.

Figure 2:
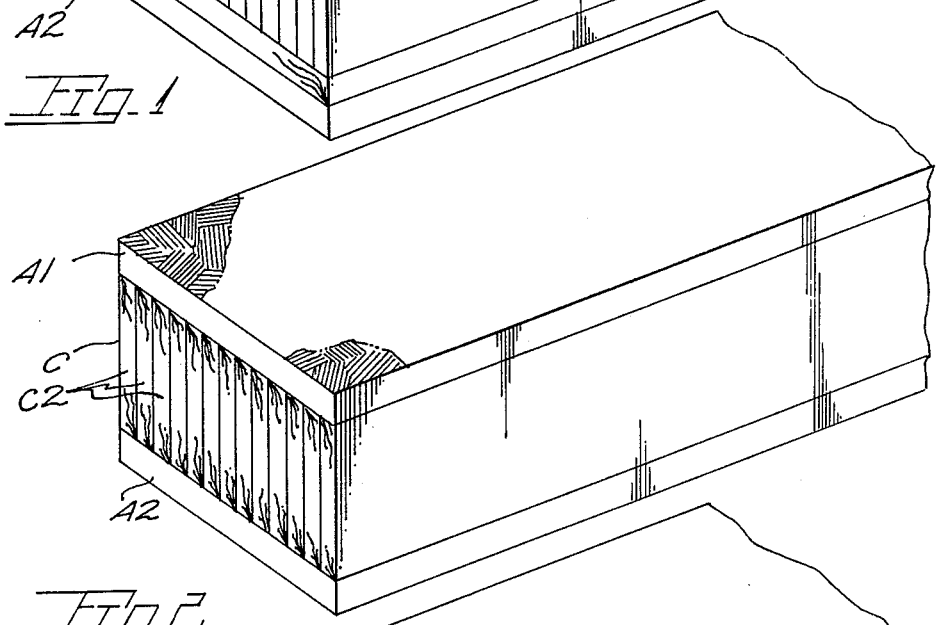
Figure 3:
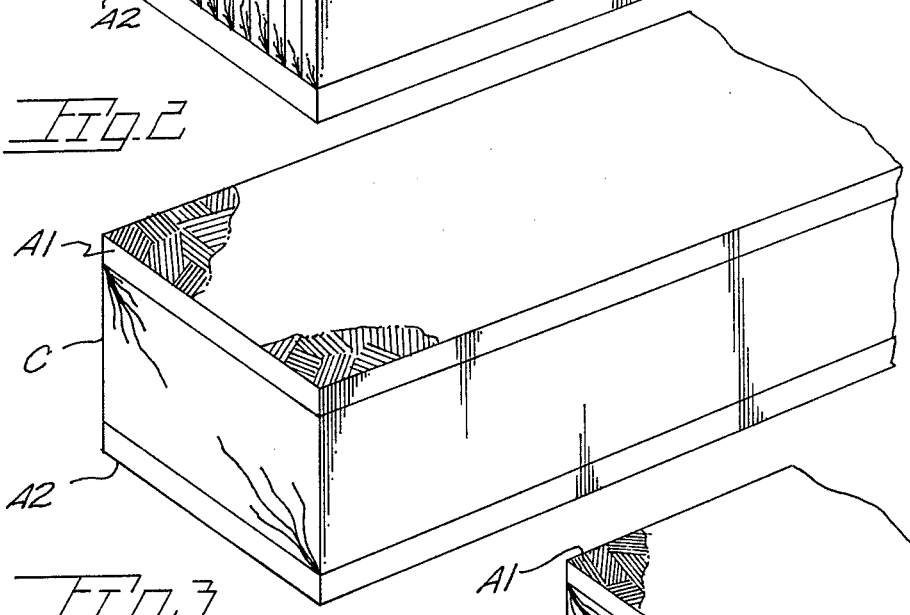

It will further be apparent that should availability, cost, and other factors favor the selection of lumber as element C, it may also be feasible to embody component C with elements B-1, and B-2 as one member continuous from the boundary A-1 to A-2 per FIG. 3. This is possible if the grade and species requirement of elements B-1 and B-2 for tensile and bending strength are economically acceptable for element C. It will be noted that the economic equation must take cognizance of the cost saving by only one or two glue lines in such a combination. Another alternative is the combination of outer elements A-1, A-2 with a central all wood component of laminated construction per FIG. 2 with wood lamina C-2.

Figure 4:
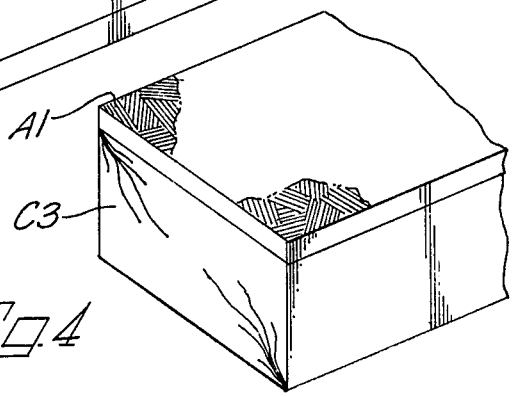
Figure 5:
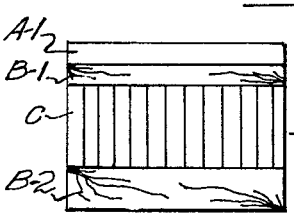
FIG. 5 is an end view.

In FIG. 4, a single outer element A-1 is used adhesively joined with a dimensioned wooden board C-3.

The examples below will serve to further illustrate the physical properties associated with the railroad tie of the present invention.

EXAMPLE 1

This example illustrates the compression resistance of various materials and the correlation of that resistance with the density the material. Various wood particleboards and various species and densities of lumber were tested by applying an increasing load to a 0.500 inch ball in contact with the surface of the woody material being tested. The load in pounds was recorded at the point the 0.500 inch ball was imbedded to 0.250 inch in the subject material. The results are set out in Table 1.

TABLE 1

| DESCRIPTION | DENSITY | LBS. TO 6.35 mm |
|---|---|---|
| Ponderosa Pine lumber | 0.460 | 534 |
| Douglas fir lumber | 0.423 | 471 |
| Douglas fir lumber | 0.633 | 1068 |
| White Oak lumber | 0.782 | 1193 |
| Particleboard Douglas fir | 0.77 | 1507 |
| Particleboard Douglas fir* | 0.81 | 1633 |
| Particleboard Douglas fir* | 0.87 | 1821 |
| Particleboard Douglas fir | 0.97 | 3913 |

*Contained recycled, creosote containing comminuted wood.
The results illustrate the correlation between crushingstrength and density of both wood and consolidated articles.

EXAMPLE 2

Douglas fir particleboard was consolidated in a hotpress to a thickness of 19mm at a temperature of 350° F, and a moisture content based upon bone dry fiber of 9.5 to 10.5%. The consolidating pressure was varied to give a press close time, to the final 19.05 mm thickness within the range of 70 seconds to 100 seconds when the amount of material being consolidated was varied so as to result in a final density of 0.77 to 0.97 grams per cubic centimeter. The following table illustrates the correlation of density and pressure under these conditions.

TABLE II

| PRESSURE | DENSITY |
|---|---|
| 400 psi | 0.77 |
| 500 psi | 0.81 |
| 800 psi | 0.87 |
| 1000 psi | 0.94 |
| 1400 psi | 0.97 |

EXAMPLE 3

A miniaturized composite tie was constructed to have approximately the proportionate thickness of the described elements to illustrate the functional beam strength of such composite construction.

The outermost elements, A-1 and A-2, were composed of Douglas fir particleboard of thickness 0.212 inch, having a density of 0.97 g/cc. The adjacent elements, corresponding to B-1 and B-2 in the above detailed embodiments, were composed of Douglas fir lumber 0.212 inch thick and density 0.45 g/cc, having a modulus of rupture as tested on the immediately adjacent section, of 13,500 psi. The centermost component C, was composed of a number of pieces C-1 of the particleboard of element A-1 and A-2 with broad surfaces perpendicular to the broad surfaces of B-1 and B-2 spacing them a distance of $\frac{5}{8}$ inch. The entire assembly was adhesively unitized with a coldsetting urea-formaldehyde glue on the interfaces between elements A-1 and B-1, B-1 and C, C and B-2, and B-2 and A-2 resulting in a unit 1.47 inch deep. The unit was then tested to failure for modulus of rupture, and loading opposite supports on 8 inch apart centers, according to ASTM method 1037–74. The modulus of rupture was 7100 psi. This is 53% of the MOR of the above mentioned lumber component, or 13,500 psi, which component comprises under 29% of the cross-sectional depth of the composite member. As MOR of 5,900 psi has been determined adequate for railroad ties by independent field performance studies. The 0.97 g/cc density particleboard used herein had a modulus of rupture of 5,580 psi and a rating of 3,913 pounds to imbed a 0.500 inch diameter steel ball to a depth of 0.250 inch. When the imbedding pressure was released, the springback recovered 0.096 inch of the imbedding depth.

While I have shown but a few embodiments of the invention it will be apparent to those skilled in the art that the invention may be embodied still otherwise without departing from the spirit and scope of the claimed invention.

Having thus described the invention what is desired to be secured under a Letters Patent is:

1. A railroad tie of composite construction, said tie comprising in combination, uppermost and bottommost elements of rectangular section constituting the top and bottom surfaces of the tie, said elements comprised of hotpressed comminuted liqnocellulosic material having a density range of 0.75 to 1.2 grams per cc, an innermost component containing the tie neutral axis at laminated hotpressed particleboard consisting of particleboard lamina, each lamina having its broad faces perpendicular to and offset from said elements, each of said particleboard lamina having its fibres substantially in parallel relationship to the lamina broad faces and thereby contributing significant horizontal shear strength to the tie, dimensioned lumber elements extending the length of the tie and located immediately above and below said innermost component, said lumber elements having a grain direction parallel to and offset from the tie neutral axis, said dimensioned lumber elements offset remotely above and below the tie neutral axis and thereby contributing tensile strength to resist ending loads applied to the tie, and adhesive means joining all tie components into a unitary mass.

* * * * *